United States Patent [19]

Arikawa et al.

[11] 4,146,861

[45] Mar. 27, 1979

[54] QUICK-ACTING FUSE ARRANGEMENT

[75] Inventors: Hiroo Arikawa, Tokyo; Akira Taniguchi; Masaya Maruo, both of Yokohama, all of Japan

[73] Assignee: San-O Industrial Corp., Tokyo, Japan

[21] Appl. No.: 816,284

[22] Filed: Jul. 18, 1977

Related U.S. Application Data

[63] Continuation-in-part of Ser. No. 671,161, Mar. 29, 1976, abandoned.

[51] Int. Cl.[2] ..... H01H 85/04

[52] U.S. Cl. ..... 337/159; 337/164; 337/292; 337/295

[58] Field of Search ..... 337/159, 161, 162, 164, 337/176, 237, 292, 295, 290

[56] References Cited

U.S. PATENT DOCUMENTS

| | | | |
|---|---|---|---|
| 1,411,946 | 4/1922 | West | 337/237 |
| 2,354,134 | 7/1944 | Ludwig et al. | 337/295 X |
| 3,061,700 | 10/1962 | Fister | 337/164 |
| 3,089,012 | 5/1963 | Abrams | 337/290 X |

*Primary Examiner*—Robert J. Hickey

[57] ABSTRACT

A novel fuse arrangement for electrical and electronic circuits is provided having shorter arcing time and arc-extinguishing time as compared to the prior art fuses. The fuse arrangement described herein comprises a pair of electrodes having contact terminals for connection to the circuit and a support member preferably disposed triangularly relative to the electrodes. In one embodiment, a fusible wire elment is stretched between the electrodes and has its mid portion supported by the support member. The support member is made from a material of large heat capacity and high thermal conductivity to provide a heat dissipating surface for the heat generated in the fusible wire element.

8 Claims, 6 Drawing Figures

QUICK-ACTING FUSE ARRANGEMENT

RELATED APPLICATION

This application is a continuation-in-part of copending application Ser. No. 671,161, filed Mar. 29, 1976, now abandoned.

BACKGROUND OF THE INVENTION

1. Field of Invention

This invention relates to fuses and is particularly related to a fuse arrangement which is, due to its novel construction, quick melting and exhibits short arcing time and remarkably improved arc-extinguishing characteristics, and hence affords greater protection for electrical and electronic circuitry when excess current flows through the circuit.

2. The Prior Art

A variety of fuses and fuse arrangements are commonly used to protect different electrical and electronic circuits against damage or desctruction when excessive current, i.e., a current in excess of the rated capacity of the fuse, flows through the circuit. Such fuses, for example, are described in U.S. Pat. No. 1,411,946, issued to M. J. West on Apr. 4, 1922; U.S. Pat. No. 2,441,692, issued to R. H. Earle on May 18, 1948, and U.S. Pat. No. 3,061,700 which was granted to A. J. Fister on Oct. 30, 1962.

The fuse described by West comprises a casing having an opening covered by a hinge closure, terminal contact members closing the ends of the casing and a fusible link which connects the terminal contact members.

Earle describes a fuse unit which comprises two so-called "expulsion" fuses connected in series, with each fuse introducing substantial resistance in the circuit during the flow of electric current, thus reducing the value of "fault currents" below the value it would normally be if only a single fuse was employed.

Fister provides a protector for electric circuits to solve the so-called "pressure generation problem." This is accomplished by subdividing the fusible elements of the fuses into a number of short fusible elements, each disposed in different but contiguous compartments, in series, within the housings of the fuses. As shown in FIGS. 1 and 2, Earle provides passageways 34 between successive compartments to provide escape for the vapors and gasses generated in each compartment when the fuse element therein blows, and the various compartments are filled with sand or anhydrous calcium sulfate which act as "arc-quenching" media.

The fuses described in the aforementioned patents, and the prior art fuses in general, are not entirely satisfactory to meet the stringent demands of some electrical circuitry such as, for example, integrated circuitry, in which the fuse elements are frequently stretched between electrodes which are spaced as narrow as 1 to 2 mm apart. Additionally, the arc-extinguishing time in such circuits must be extremely short to protect them against damage or destruction.

Accordingly, it is an object of this invention to provide an improved fuse unit.

It is a further object of this invention to provide an improved fuse unit which is, due to unique arrangement of its various constituents, particularly useful in integrated electric and electronic circuitry.

It is also an object of this invention to provide a fuse arrangement in which the fuse elements are quick melting and which has a short arcing time and remarkably improved arc-extinguishing characteristics.

The foregoing and other objects and improved features of the novel fuse arrangement of this invention will be more clearly comprehended from the following detailed description of the invention taken in conjunction with the accompanying drawings which form a part of this application.

SUMMARY OF THE INVENTION

In accordance with this invention, there is provided a unique fuse arrangement which is quick acting and which has shorter arcing time and arc-extinguishing time as compared to the prior art fuses. The fuse arrangement described herein comprises a pair of spaced electrodes having contact terminals for connection to an electrical or electronic circuit, and in one embodiment a support member of large heat conductivity and high heat capacity is triangularly disposed relative to the electrodes. The electrodes and the support member are installed within a suitable insulating board or plate and a fusible wire element is stretched between the electrodes such that the mid-portion thereof is in intimate contact with and is supported by said support member.

The support member is made from a material of large heat conductivity and high heat capacity and provides a heat-dissipating surface for the heat generated in the fusible wire element for more effective cooling, shorter arcing time and quicker arc-extinguishing behavior.

Other embodiments of the invention are described, all of which provide a fuse arrangement which affords greater protection for electrical and electronic circuitry against damage which may be caused by the flow of currents in excess of the rated capacity of the fuses.

DETAILED DESCRIPTION OF THE DIFFERENT EMBODIMENTS OF THE INVENTION

Figure 1:
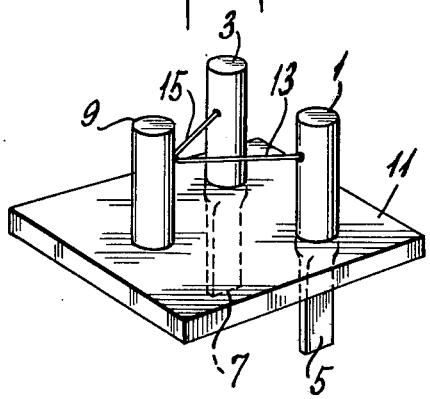
FIG. 1 is a perspective view of a fuse arrangement constructed according to one embodiment of this invention.
Figure 2:
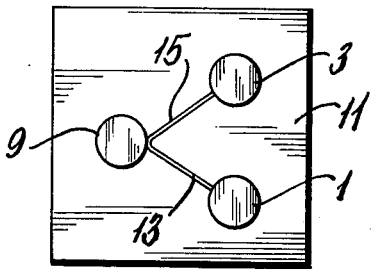
FIG. 2 is a plan view of the fuse arrangement shown in FIG. 1.

Referring to the drawings wherein like reference numerals are employed to designate like parts, and particularly first to FIGS. 1 and 2, there are shown two electrodes 1 and 3 which may be of conventional design and construction, each of which has a contact terminal 5 and 7 for connection, in series, with an electrical circuit (not shown). A supporting member 9 is disposed triangularly with respect to said electrode such that the supporting member forms the apex of an imaginary triangle. The electrodes 1 and 3 and the supporting member 9 are installed on a suitable insulating board or plate 11 as shown in FIG. 1.

A first fusible wire element 13 is stretched between the electrode 1 and supporting member 9, and a second fusible wire element 15 is stretched between the electrode 3 and the supporting member 9 and is connected (such as by soldering) to the first fusible element 13. Both fusible wire elements 13 and 15 are preferably made of the same filamentary material and have the same cross sectional area throughout their entire length. In the embodiment illustrated in FIGS. 1 and 2, the fusible wire elements are joined together on the surface of the support member 9.

In use, the contact terminals 5 and 7 are connected in series to the electrical or electronic circuit (not shown) and, when voltage is applied across said terminals, current begins to flow through the circuit. If the current flowing through the circuit exceeds the rated capacity of the fusible wire elements, either one of the two fusible elements begins to melt. Thus, for example, when the fusible wire element 13 (or 15) melts, it causes the other fusible wire element to melt by the electric arc generated in the fusible wire element 13 or 15, as the case may be. When both fusible wire elements have melted, the electrical arc will span the distance between the two electrodes and the resistance to this arc will double. Consequently, the arcing time is decreased and the arc extinguishes more rapidly to complete the circuit.

The use of the support member constitutes a critical feature of this invention. This support member is made from a material having large heat capacity and high heat conductivity such as, for example, most conductor metals.

The support member 9 provides a heat dissipating surface which serves to cool the fusible wire lements and improve the arc-extinguishing characteristics by approximately twice the length of the arc as compared to the arc length between one of the electrodes and the supporter. It thus serves as a media for more rapid dissipation of the heat which is generated in the fusible wire elements during the passage of electrical current.

Figure 3:
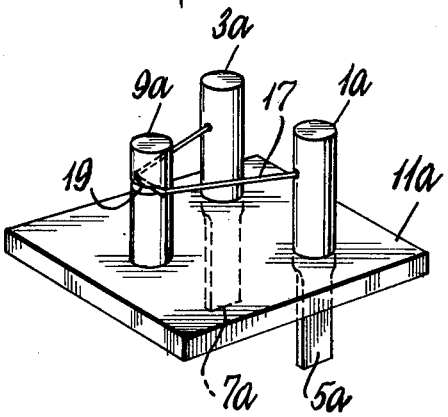
FIG. 3 is a perspective view of a fuse unit arranged in accordance with a different embodiment of this invention.
Figure 4:
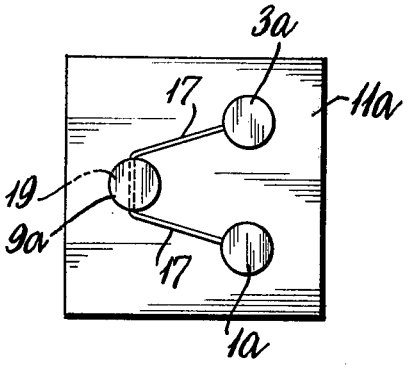
FIG. 4 is a plan view of the fuse arrangement illustrated in FIG. 3.

Referring now to FIGS. 3 and 4, the fuse arrangement illustrated therein is essentially similar to the embodiment depicted in FIGS. 1 and 2. Thus, there are shown two electrodes 1*a* and 3*a* having contact terminals 5*a* and 7*a* for series connection with an electrical or electronic circuit. The support member 9*a* is disposed at the apex of an imaginary triangle and the electrodes 1*a* and 3*a*, together with the support member 9*a* are installed on a suitable insulating board or plate 11*a* as shown in FIG. 3.

A fusible wire element 17 is stretched between the two electrodes with is mid portion lapped around the support member 9*a* in contact therewith in the circumferential groove 19 as shown in FIG. 3.

Once again when the contact terminals 5*a* and 7*a* are connected, in series, to an electrical or electronic circuit (not shown) and voltage is applied across the electrodes, current begins to flow through the circuit. If this current exceeds the rated capacity of the fusible wire element, a portion of the wire melts causing detachment of the fusible wire element from the support member. Consequently, the arc must travel the entire distance between the electrodes and the arc resistance becomes so large that the arc current rapidly extinguishes to complete the interruption of the electric circuit.

As in the previous embodiment, the support member provides a surface for more rapid dissipation of heat generated in the fusible wire element 17 thus resulting in more improved arc extinguishing characteristics.

Figure 5:
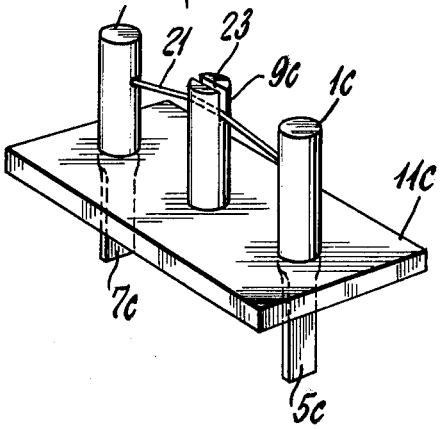
FIG. 5 is a perspective view of still another fuse arrangement according to a further embodiment of this invention.
Figure 6:
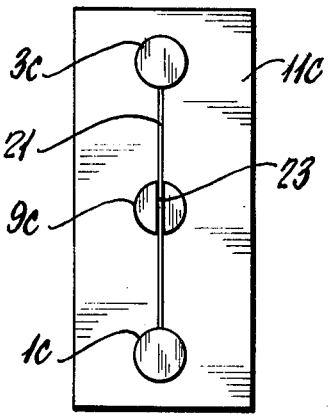
FIG. 6 is a plan view of the fuse arrangement shown in FIG. 5.

The embodiment illustrated in FIGS. 5 and 6 is essentially similar to the arrangement illustrated in FIGS. 3 and 4 except that the support member is disposed intermediate of the two electrodes rather than triangularly. This embodiment comprises two electrodes 1*c* and 3*c* having contact terminals 5*c* and 7*c*, respectively, and a support member 9*c* which is disposed intermediate the electrodes. The support member 9*c* and the electrodes 1*c* and 3*c* are installed on an insulating board or plate 11*c* as in the previous embodiments of the invention.

A fusible wire element 21 is stretched between the two electrodes and has its mid portion resting in a groove 23 formed at the top of the supporting member as shown in FIGS. 5 and 6. The operation of the fuse arrangement is otherwise similar to the previous two embodiments and the fuse exhibits quick melting and more improved arc-extinguishing characteristics.

The melting time, arcing time and arc-extinguishing time of a fuse constructed according to the embodiment illustrated in FIG. 1 herein were compared to a typical prior art fuse made without the use of the support member of this invention. The distance between the electrodes was 1 mm., the rated current was 2 amperes, the applied voltage was 125 volts and the experiments were conducted by passing a current which was twice the rated current of the fuse. The results are shown in tabular form as follows:

TABLE

| | Type of Current | Melting Time, m.sec. | Arcing Time, m.sec. | Arc Extinguishing Time, m.sec. |
|---|---|---|---|---|
| | AC | 4.7 | 2.8 | 7.0 |
| prior | AC | 3.8 | 3.9 | 7.7 |
| art fuse | DC | 5.2 | longer | longer |
| | DC | 5.5 | than 1000 | than 1000 |
| | | | longer | longer |
| | | | than 1000 | than 1000 |
| fuse of this | DC | 5.3 | 0.2 | 5.5 |
| invention | DC | 5.1 | 0.1 | 5.2 |

As is evident from the above table, the fuse arrangement of this invention exhibits remarkably shorter arcing time and arc-extinguishing time as compared to the prior art fuses. Accordingly, their use in most electrical and electronic circuits affords greater protection against damage and destruction caused by the flow of excess electrical current through such circuits.

What is claimed is:

1. A fuse unit for electrical and electronic circuits comprising a pair of spaced electrodes having terminals adapted to be connected in series in such circuits, a support member having large heat capacity and high thermal conductivity disposed triangularly relative to said electrodes, substantially equidistantly therefrom; a first fusible wire element having substantially uniform cross sectional area stretched between said support member and one of said electrodes and a second fusible wire element having substantially uniform cross sectional area stretched between said other electrode and said support member such that one end thereof is attached to the end of said first fusible wire element on said support member so that when an overcurrent causes one of said fusible wire elements to melt, the electric arc generated therein causes the other fusible element to melt and interrupt the circuit.

2. A fuse unit as in claim 1 wherein said support member is a metal conductor.

3. A fuse unit for electrical and electronic circuits comprising a pair of spaced electrodes having terminals adapted to be connected in series in such circuits; a support member having large heat capacity and high thermal conductivity disposed triangularly relative to said electrodes, substantially equidistantly therefrom; a fusible wire element having substantially uniform cross sectional area stretched between said electrodes having its mid-portion lapped around said support member in intimate contact therewith such that when an overcurrent causes a portion of said fusible wire element between one of said electrodes and said support member to melt, the electric arc generated therein causes the other portion of the fusible element to melt and interrupts the circuit.

4. A fuse as in claim 3 wherein said support member has a peripheral groove for accommodating said midportion of said fusible wire element which is in intimate contact with said support member.

5. A fuse as in claim 3 wherein said support member is a metal conductor.

6. A fuse as in claim 4, wherein said support member is a metal conductor.

7. A fuse unit for electrical and electronic circuits comprising a pair of spaced electrodes having terminals adapted to be connected in series in such circuits, a support member having large heat capacity and high thermal conductivity disposed intermediate said electrodes, substantially equidistantly therefrom, said support member having a partially extending groove at the top thereof, and a fusible wire element having uniform cross sectional area stretched between said electrodes with its midportion resting in said groove in intimate contact with said support member such that when an overcurrent causes a portion of said fusible wire element to melt, the electrical arc generated therein causes the other portion of the fusible element to melt and interrupt the circuit.

8. A fuse as in claim 7 wherein said support member is a metal conductor.

* * * * *